US006920856B2

(12) United States Patent
Lee

(10) Patent No.: US 6,920,856 B2
(45) Date of Patent: Jul. 26, 2005

(54) CAMSHAFT MOUNTING STRUCTURE FOR A CYLINDER HEAD

(75) Inventor: Seung-Woo Lee, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/622,576

(22) Filed: Jul. 21, 2003

(65) Prior Publication Data

US 2004/0211385 A1 Oct. 28, 2004

(51) Int. Cl.[7] ..... F02F 1/00; F01M 1/06

(52) U.S. Cl. ..... 123/90.34; 123/196 M; 123/193.5

(58) Field of Search ..... 123/196 R, 90.33, 123/90.34, 90.17, 90.16, 193.5, 196 M

(56) References Cited

U.S. PATENT DOCUMENTS 5,143,034 A * 9/1992 Hirose ..... 123/196 R
5,954,019 A * 9/1999 Yoshikawa et al. ..... 123/90.17
6,032,629 A * 3/2000 Uchida ..... 123/90.34
6,035,817 A * 3/2000 Uchida ..... 123/90.17
6,076,492 A * 6/2000 Takahashi ..... 123/90.17

FOREIGN PATENT DOCUMENTS

JP 2000-328908 11/2000

* cited by examiner

*Primary Examiner*—Henry C. Yuen
*Assistant Examiner*—Hyder Ali
(74) *Attorney, Agent, or Firm*—Morgan Lewis & Bockius LLP

(57) ABSTRACT

The camshaft mounting structure for a cylinder head includes a journal part placed at the front of a cylinder head and supports a camshaft and accommodates a bolt coupling hole for securing the cylinder head and the cylinder block. The cylinder block includes oil holes communicating with oil passages for connecting with an actuator of a timing apparatus. A metal bearing is mounted on the journal part with a length identical to the maximum length of the journal part in relation to the axial direction of the camshaft, and formed with connecting holes communicating with the oil holes. Oil grooves are formed at the camshaft along the circumferential direction for communicating with the connecting holes.

7 Claims, 3 Drawing Sheets

CAMSHAFT MOUNTING STRUCTURE FOR A CYLINDER HEAD

FIELD OF THE INVENTION

The present invention relates to a camshaft mounting structure for a cylinder head and, more particularly, to a camshaft mounting structure for a cylinder head devised to compact a cylinder head of an engine using a variable valve timing apparatus.

BACKGROUND OF THE INVENTION

In general, a continuous variable valve timing apparatus is designed either to advance or retard the opening and closing times of intake and exhaust valves for improving an engine output and combustion stability.

Some continuous variable valve timing apparatus use oil supplied from an oil pump to a cylinder head through a cylinder block for lubricating slidable parts of an engine. The oil both activates the continuous variable valve-timing apparatus and lubricates intake and exhaust camshafts.

SUMMARY OF THE INVENTION

The present invention is disclosed to smoothly lubricate a space between a camshaft and a journal supporting the camshaft of a cylinder head. The present invention is further disclosed to minimize an axial length of the journal whereby the cylinder head can be compacted.

In accordance with one object of the present invention, the camshaft mounting structure for a cylinder head comprises a first journal part placed at the frontal part of the cylinder head of the engine, which is installed with a plurality of oil holes communicating with a plurality of oil passages for connecting with an actuator of the variable valve timing apparatus. The first journal is designed to support a camshaft, and also accommodates a bolt coupling hole for securing the cylinder head and a cylinder block. The camshaft mounting structure further comprises a metal bearing mounted on the first journal part in a semi-circular shape and a length identical with a maximum length of the first journal part in relation to the axial direction of the camshaft, and formed with a plurality of connecting holes communicating with the plurality of oil holes. A plurality of oil grooves is formed at the camshaft along the circumferential direction for respectively communicating with the plurality of connecting holes.

BRIEF DESCRIPTION OF THE DRAWINGS

For fuller understanding of the nature and objects of the present invention, reference should be made to the following detailed description taken in conjunction with the accompanying drawings in which.

DETAILED DESCRIPTION OF THE INVENTION

Figure 1:
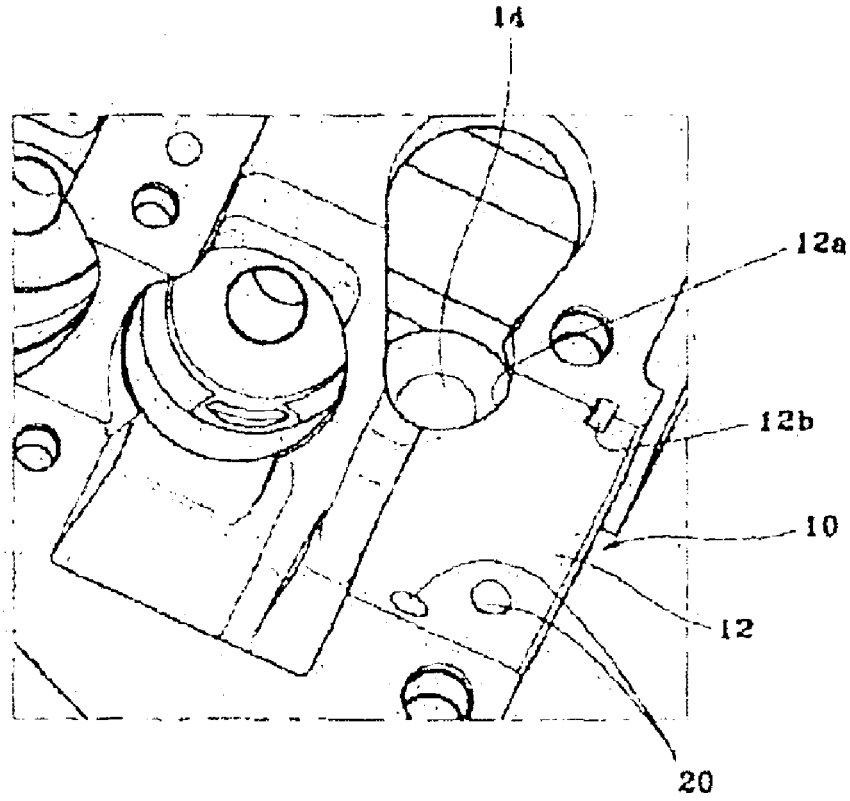
FIG. 1 is a perspective view illustrating a first journal part of a cylinder head according to an embodiment of the present invention.
Figure 2:
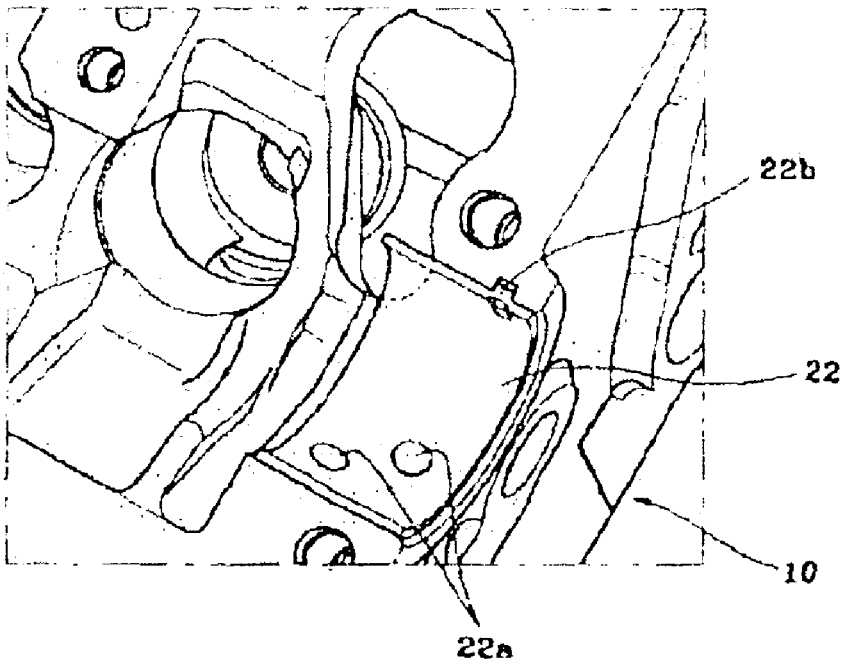
FIG. 2 is a perspective view illustrating a mounted state of a metal bearing on the first journal part of the cylinder head of FIG. 1.
Figure 3:
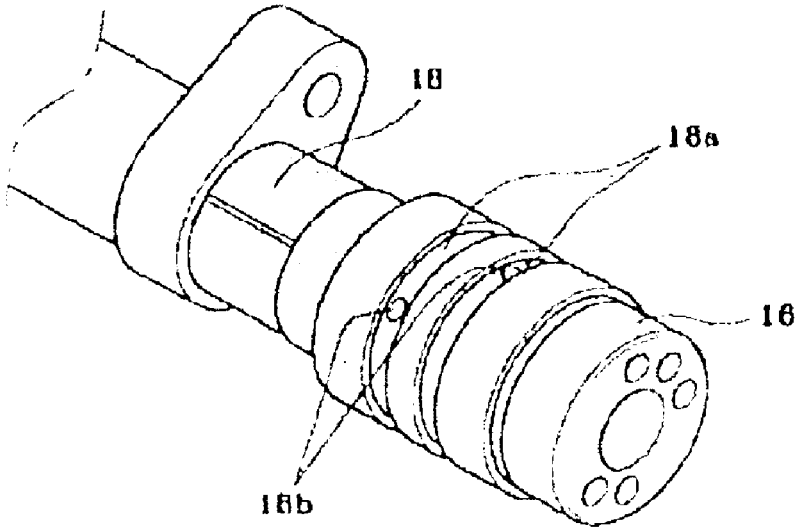
FIG. 3 is a perspective view illustrating a camshaft before it is mounted at the first journal part of the cylinder head of FIG. 2.

Hereinafter, the preferred embodiment of the present invention will be described in detail with reference to the accompanying drawings.

In an engine using a variable valve timing apparatus according to the embodiment of the present invention, a cylinder head (10) is formed with a first journal part (12), wherein the first journal part (12) is placed at the frontal part of the engine and takes a form of a concave semi-circle shape. The first journal part (12) is formed with two oil holes (20) distantly mounted along the axial direction of the cylinder head (10) for activating the variable timing apparatus.

The two oil holes (20) communicate with oil galleries (not shown) formed inside the cylinder head (10). This structure allows oil to be supplied from or returned to the oil galleries. The diameters of the two oil holes (20) should preferably be at least 6 mm.

An edge of the first journal part (12) is partially cut out for forming a cut out section (12*a*). The cut out section (12*a*) is a curve at one edge of the first journal part (12) in order to allow a tool to be easily inserted through a bolt coupling hole (14).

In other words, the edge of the first journal part (12) is overlapped with some portions of the bolt coupling hole (14) formed for coupling the cylinder head (10) and the cylinder block (not shown).

The first journal part (12) of the cylinder head (10) is also formed with a fixing groove (12*b*) distantly placed from the center of the overall axial length of the first journal part away from the cut out section (12*a*), at another edge of the first journal part (12). The fixing groove (12*b*) is concavely depressed from the surface of the first journal part (12) and is formed at the border of the upper end of the first journal part (12) and the upper surface of the cylinder head (10).

Figure 4:
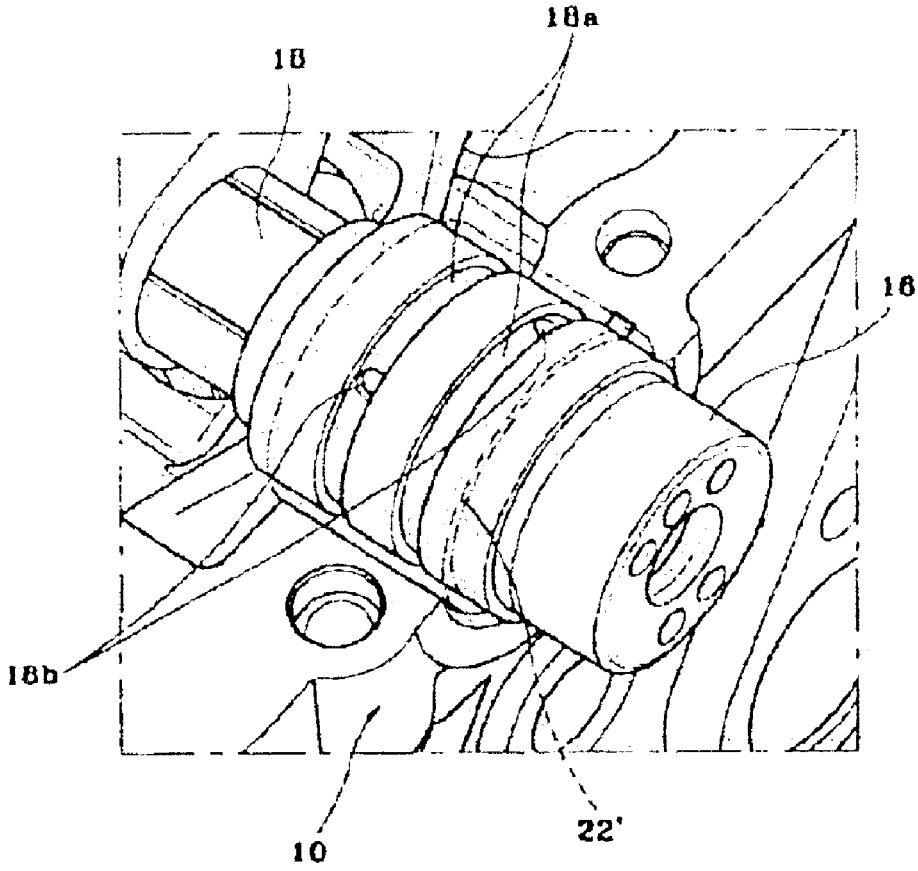
FIG. 4 is a perspective view illustrating a mounted state of the camshaft at the first journal part of the cylinder head of FIG. 2.
Figure 5:
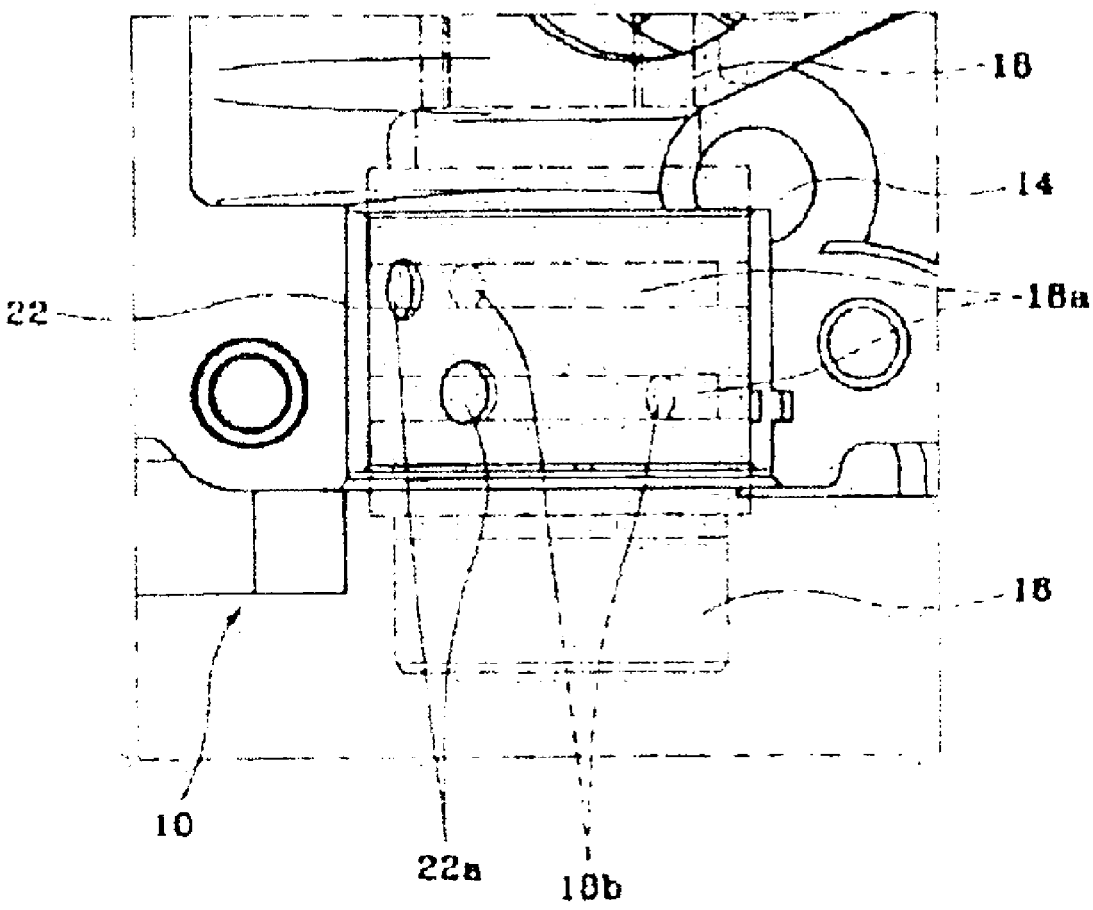
FIG. 5 is a plan view of FIG. 4.

On the other hand, the first journal part (12) of the cylinder head (10) is mounted thereon with a metal bearing (22) having a semi-circular shape. The metal bearing (22) is mounted thereon with a camshaft (18). A semi-circular metal bearing (22', shown in FIG. 4) and a cam cap (not illustrated) are sequentially coupled around the camshaft (18) for being screwed to the cylinder head.

The axial length of the metal bearing (22) is preferably established to conceal the cut out section (12*a*) formed at the first journal part (12).

The metal bearing (22) is formed with connecting holes (22*a*) corresponding to the oil holes (20) of the first journal part (12). The connecting holes (22*a*) are made to either allow oil to be supplied or exhausted via the oil holes (20) of the first journal part (12). The diameters of the connecting holes (22*a*) are established to preferably be at least 6 mm, which is the same with those of the oil holes (20).

The metal bearing (22) is also formed with a fixing protruder (22*b*) corresponding to the fixing groove (12*b*) of the first journal part (12). The fixing protruder (22*b*) is designed to be coupled to the fixing groove (12*b*) of the first journal part (12) for securing the metal bearing (22) onto the first journal part (12).

On the other hand, the camshaft (18) is formed with oil grooves (18*a*) concaved along the overall circumferential surface of the camshaft (18) at a corresponding place with the connecting holes (22*a*) of the metal bearing (22).

The oil grooves (18*a*) are respectively with the oil holes (18*b*) for communicating with the connecting holes (22*a*). Each oil groove (18*a*) functions as a passage either for supplying or returning the oil via the oil holes (18*b*) to an actuator (16) of the variable valve timing apparatus mounted at a front end of the camshaft (18).

The widths of the oil grooves (18*a*) are approximately 3–5 mm, preferably 4 mm. Each oil groove (18*a*) is distantly mounted at 7 mm intervals, at minimum. The distance between the oil grooves (18*a*) is preset which is experimentally calculated for preventing a mutual intermixture of oil fed to respective oil grooves (18*a*) when the variable valve timing apparatus is activated through two oil passages formed between the connecting holes (22*a*) of the metal bearing (22) and the oil grooves (18*a*) of the camshaft (18).

The widths of the oil grooves (18*a*) are smaller than each diameter of the connecting holes (22*a*), such that some of oil furnished via the connecting holes (22*a*) to the oil grooves (18*a*) can be flowed into a space between the metal bearing (22) and the camshaft (18) for lubrication.

Also, the diameters of the oil holes (20) and the connecting holes (22*a*) are preferably the same in size for preventing leakage of the oil therebetween.

The first journal part (12) of the cylinder head (10) is placed to partially overlap with the bolt connecting hole (14) such that the first journal part (12) is mounted thereon with the metal bearing (22) where the camshaft (18) is installed.

At this time, the oil supply route for supplying or returning oil to the variable valve timing apparatus is formed between the connecting holes (22*a*) of the metal bearing (18) and the oil grooves (18*a*) of the camshaft, not between the oil holes (20) formed at the first journal part (12) and the oil grooves (18*a*) formed at the camshaft.

Even if the first journal part (12) of the cylinder head (10) is partially cut out for the bolt coupling hole (14), oil required for the variable valve timing apparatus can be smoothly supplied and returned. Therefore, the first journal part (12) can be placed to partially overlap with the bolt coupling hole (14), reducing the overall axial length of the cylinder head (10).

Moreover, a part of the oil holes (20) formed at the first journal part (12) can be formed in a maximum width along a circumferential direction of the first journal part (12) cut out for the bolt coupling hole (14).

As apparent from the foregoing, there is an advantage in the embodiment of the present invention in that an axial length of a first journal part (12) formed for mounting a camshaft (18) at a cylinder head (10) is formed with a partially cut out section for a bolt coupling hole (14), enabling to design a compact engine by reducing the overall axial length of the cylinder head (10).

There is another advantage in that the first journal part (12) is mounted thereon with a metal bearing (22) wherein the camshaft (18) formed with oil grooves (18*a*) is accommodated along the overall periphery of the metal bearing (22), allowing part of the oil moving between connecting holes (22*a*) of the metal bearing (22) and the oil groove (18*a*) of the camshaft (18) to flow between the contacting part of the metal bearing (22) and the camshaft (18), leading to smooth lubrication.

What is claimed is:

1. A camshaft mounting structure for a cylinder head, the structure comprising:

a first journal part which is placed at the frontal cylinder head of an engine, is designed to support a camshaft, and also accommodates a bolt coupling hole for securing said cylinder head and a cylinder block, wherein said cylinder head is installed with a plurality of oil holes communicating with a plurality of oil passages for connecting with an actuator of the variable valve timing apparatus;

a metal bearing which is mounted on said semi-circular shaped first journal part with a length identical to the maximum length of said first journal part in relation to the axial direction of said camshaft is formed with a plurality of connecting holes communicating with said plurality of oil holes; and a plurality of oil grooves formed at said camshaft along the circumferential direction for respectively communicating with said plurality of connecting holes, wherein the widths of said oil grooves are smaller than each diameter of said holes, and the diameters of said oil holes and said connecting holes are substantially the same in size.

2. The structure as defined in claim 1, wherein said first journal part is formed with a fixing groove concavely depressed from a surface thereof at a place inclined to one side from the center of the overall axial length of said first journal part, and said metal bearing is formed with a fixing protruder coupled with said fixing groove for indicating the installation direction and securing the installation state of said metal bearing.

3. The structure as defined in claim 2, wherein said fixing groove is formed at the border of the upper end of said first journal part and the upper surface of said cylinder head.

4. The structure as defined in claim 1, wherein said first journal part partially accommodates said bolt coupling hole by overlapping with an edge of the inner side of said cylinder head of said first journal part.

5. The structure as defined in claim 4, wherein a part of said plurality of oil holes formed at said first journal part are formed in a maximum width in a circumferential direction of said first journal part cut out for said bolt coupling hole.

6. The structure as defined in claim 1, wherein the diameters of said oil boles and said connecting holes are respectively greater than or equal to 6 mm, the widths of said oil grooves are 3–5 mm, and each oil grooves are distantly mounted at intervals equal to or greater than 7 mm.

7. The structure as defined in claim 1, wherein said oil grooves are respectively formed with oil holes mutually communicating with connecting holes of said metal bearing for supplying or returning oil to said actuator of the variable valve timing apparatus.

* * * * *